US007011586B2

(12) United States Patent
Toyosawa et al.

(10) Patent No.: US 7,011,586 B2
(45) Date of Patent: Mar. 14, 2006

(54) GOLF TEE

(75) Inventors: Issei Toyosawa, Tokyo (JP); Shoji Hiroshima, Tokyo (JP)

(73) Assignee: Daiya Corporation, Tokyo (JP)

( * ) Notice: Subject to any disclaimer, the term of this patent is extended or adjusted under 35 U.S.C. 154(b) by 35 days.

(21) Appl. No.: 10/773,034

(22) Filed: Feb. 5, 2004

(65) Prior Publication Data

US 2004/0166964 A1 Aug. 26, 2004

(30) Foreign Application Priority Data

Feb. 26, 2003 (JP) ..... 2003-049944
Feb. 26, 2003 (JP) ..... 2003-049945

(51) Int. Cl.
*A63B 57/00* (2006.01)

(52) U.S. Cl. ..... 473/401; 473/396

(58) Field of Classification Search ..... 473/387–403, 473/417–420

See application file for complete search history.

(56) References Cited

U.S. PATENT DOCUMENTS 1,413,496 A * 4/1922 Sibbald ..... 473/398
1,551,207 A * 8/1925 Nial et al. ..... 473/400
3,414,268 A * 12/1968 Chase ..... 473/396
4,418,916 A * 12/1983 Matsuura ..... 473/396
4,524,974 A * 6/1985 Matsuura ..... 473/396
5,242,170 A * 9/1993 Ward ..... 473/396
6,783,470 B1 * 8/2004 Lee ..... 473/401

FOREIGN PATENT DOCUMENTS

| | | |
|---|---|---|
| JP | 63-114680 | 7/1988 |
| JP | 4-61576 | 5/1992 |
| JP | 2001-2865589 | * 10/2001 |
| JP | 2002-65917 | * 3/2002 |

* cited by examiner

*Primary Examiner*—Steven Wong
(74) *Attorney, Agent, or Firm*—Flynn, Thiel, Boutell & Tanis, P.C.

(57) ABSTRACT

The present invention provides a durable golf tee capable of conserving as much as possible the impact energy transmitted to the golf tee and preventing possible flight thereof from the ground. The golf tee comprises a stick pin, the lower end of which is formed in a tapered shape, to stick into the ground, a ball-holding member placed on the top of the stick pin and provided with a small hole at the bottom of a hollow part, and a flexible connecting member, the lower end of which is fixed on the stick pin. The connecting member is provided with a flange on the upper end for binding slidably the ball-holding member to the stick pin and inserted into a hollow part H through a small hole perforated at the bottom of the ball-holding member. Notches **4*b*1** are formed between the flange of the connecting member and the ball-holding member to let air escape upward.

4 Claims, 7 Drawing Sheets

GOLF TEE

BACKGROUND OF THE INVENTION

1. Field of the Invention

This invention relates to a golf tee, and more particularly to a golf tee capable of reducing the amount of impact energy transmitted thereto and of increasing the flight distance of a struck ball.

2. Description of Related Art

At the first tee shot (in other words "striking the ball") at a golf course, normally a golf tee for placing a golf ball is used.

Golf players have a strong desire of making the ball fly farther or increasing its flight distance. This desire is particularly strong at the time of tee shot.

Accordingly, various efforts have been made to minimize the impact energy absorbed into a golf tee by improving its construction so that the impact energy at the time of shot does not leak and may not diminish.

On each shot, the whole golf tee tends to break away from the ground and fly away. Thus, the balls are often lost.

Golf tees improved from this viewpoint include, for example, those described in the Japanese Patent Application Laid Open 4-61576 or in the Japanese Utility Model Application Laid Open 63-114680.

The former is a golf tee wherein a ciliary body protrudes from the base body and the whole body is of a simple integrated construction.

When this type of golf tee is used, it has an advantage in that the air resistance grows stronger due to the ciliary body when the lateral surface of the golf tee is struck hard by the golf club and that the golf tee does not fly far away, in other words that the risk of loss is averted.

However, this has a disadvantage in that the impact energy is absorbed into the golf tee since the wholly integrated golf tee stuck into the ground is struck by the golf club.

This presents another disadvantage in that the ciliary body protruding from the base body tend to rip off easily from the base body due to the impact and therefore is inferior in terms of durability.

On the other hand, the latter comprises a sticking part stuck into the ground, a ball holding part on which a golf ball is placed and a flexible connecting member.

This presents a disadvantage in that, at the time of the shot when the golf ball together with the ball holding part are struck hard on their side by the club head, the connecting member bends, absorbs the impact resulting from the shot and reduces the impact energy thereof.

Incidentally, this golf tee comprises a slit connecting member designed to liberate air staying below the flange of the connecting member and reduce resistance in order to avoid its flight from the ground surface.

For this reason, this golf tee presents a disadvantage in that the connecting member twists at the time of the shot resulting in its fragility and insufficient durability.

In addition, it has another disadvantage in that the screwing of the connecting member to the fixed part not only increases the whole weight but also the number of parts for its assembly and therefore the number of assembly processes.

This invention was made under such a technical background, and was made to overcome the above-mentioned problems of the conventional art.

SUMMARY OF THE INVENTION

It is therefore the object of this invention to provide a golf tee capable of conserving as much as possible the impact energy transmitted thereto, of preventing itself from flying out of the ground surface and which is durable.

In other words, (1) this invention relates to a golf tee comprising a stick pin, the lower end of which is formed in a tapered shape to stick into the ground, a ball-holding member for a ball placed on top of the stick pin and being tubular with a hollow part inside and having a small hole at the bottom of a hollow part, and a flexible connecting member the lower end of which is fixed on the stick pin and the upper end of which has a flange, and which can bind the ball-holding member to the stick pin slidably, wherein said connecting member is inserted into the hollow part through the small hole formed at the bottom of the ball-holding member, and the flanges of the connecting member has notches for letting air pass upward between the flange of said connecting member and the ball-holding member.

(2) Another invention is to provide a golf tee wherein a plurality of ribs along the axial direction of the ball-holding member are formed at regular intervals on the perimeter, and said ribs are formed so as to protrude from said round loop base.

(3) Another invention is to provide a golf tee wherein the protrusion length L of the ribs protruding from the ball-holding member is set at such a length as to not cause the ribs to deform beyond their plasticity and to become brittle even when the ribs are pressed until they contact with the round loop base at the base of the protruding ribs and the ribs are bent radially outward.

(4) Yet another invention is to provide a golf tee wherein the top of said stick pin is integrated by injection molding with the lower end of the connecting member.

(5) A further invention is to provide a golf tee wherein the top of each rib is formed in the shape of a globe.

It is possible to adopt a construction combining any of the above embodiments provided that it accomplishes the object of this invention.

According to this invention of such construction, it is possible to conserve as much as possible the impact energy transmitted to the golf tee, to avoid the flight of the golf tee from the ground and to make the golf tee durable.

BRIEF DESCRIPTION OF THE DRAWING

FIGS. 3(A) through 3(C) are descriptive illustrations showing the process of sticking a ball into the ground, wherein FIG. 3(A) shows the state before pressing the tee into the ground, FIG. 3(B) shows the condition when the tee is being pushed into the ground, and FIG. 3(C) shows the condition after the hand has released the ball and tee.

FIGS. 4(A) through 4(C) are illustrations showing the action of the golf tee at the time of a shot, wherein FIG. 4(A) shows its condition before the shot, while FIG. 4(B) shows its condition immediately after the shot, and FIG. 4(C) shows its condition when the ball-holding member has returned to the original state.

FIGS. 5(A) and 5(B) are schematic views showing the process of an insert molding by using an injection mold, wherein FIG. 5(A) shows a broken view of an injection molding mold, while FIG. 5(B) shows its joined condition.

FIG. 6(A) is a partial side view showing a variation of the ball-holding member and the connecting member, while FIG. 6(B) is a sectional view along the line B—B of FIG. 6 (A).

FIGS. 7(A) through 7(D) are descriptive illustrations showing a variety of stick pins provided with means of preventing extrication, wherein FIG. 7(A) is a stick pin provided with a plurality of cavities, FIG. 7(B) is one provided with multiple-stage arrowhead-like grooves, FIG. 7(C) is one with a spiral screw, and FIG. 7(D) is one with a small through hole.

DESCRIPTION OF THE PREFERRED EMBODIMENTS

The following discussion describes in detail the preferred embodiments of this invention with reference to drawings.

Figure 1:
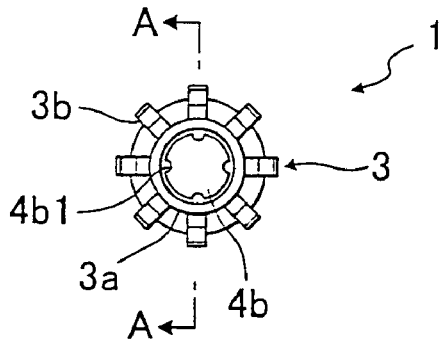
FIG. 1(A) is a top plan view of a golf tee related to an embodiment of this invention.
FIG. 1(B) is a side elevation thereof.
Figure 1:
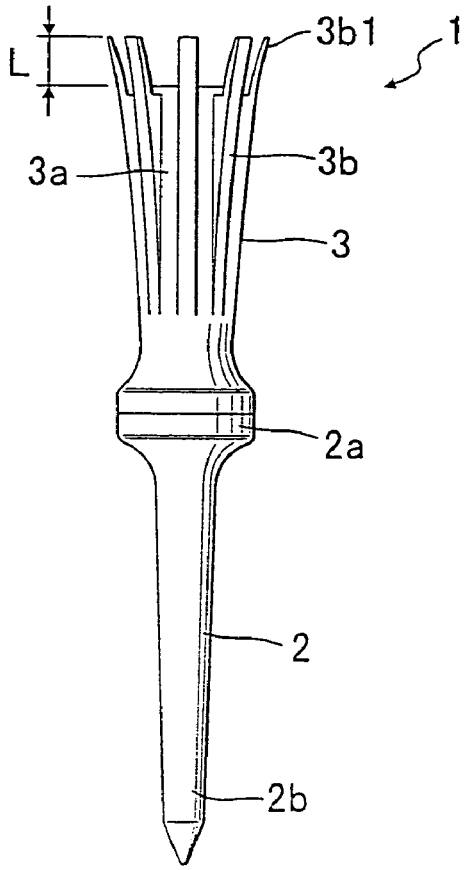

FIG. 1 shows a golf tee related to an embodiment of this invention. (A) is a top plan view, while (B) is a side elevation.

Figure 2:
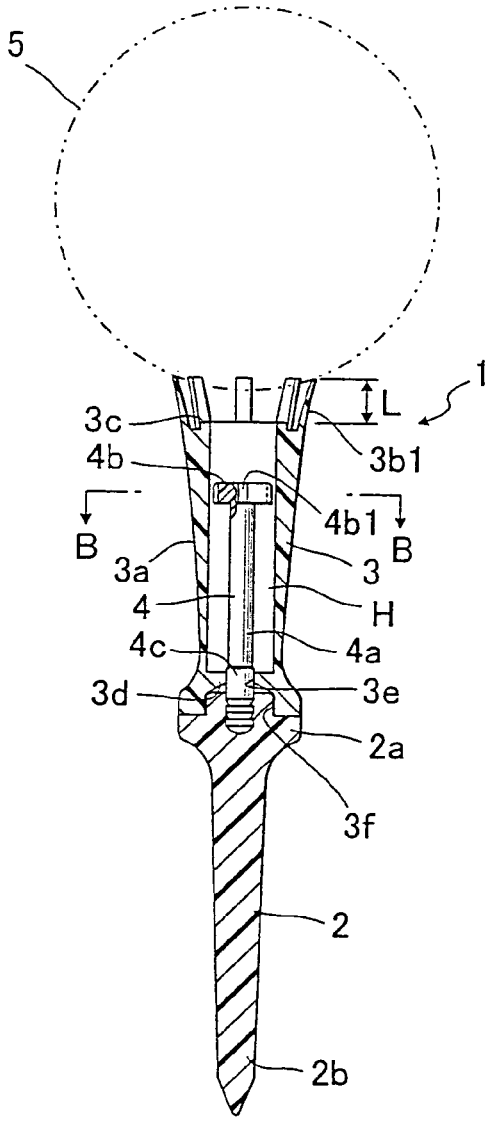
FIG. 2(A) is a sectional view of the golf tee taken along the line A—A of FIG. 1(A)
FIG. 2(B) is a sectional view along line B—B of FIG. 2(A).
Figure 2:
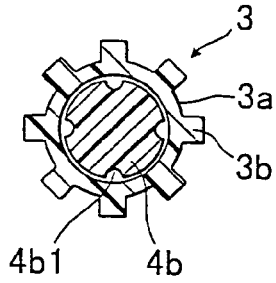

FIG. 2(A) is a sectional view along the line A—A of FIG. 1(A). FIG. 2(B) is an end view along the line B—B of FIG. 2(A).

As is evident from these drawings, the golf tee 1 comprises a stick pin 2 for sticking into the ground surface or more precisely into the ground for fixing, a ball-holding member 3 for holding a ball 5 and a flexible connecting member 4 for connecting both of these members.

The stick pin 2 has a tapered lower end 2*b* which facilitates sticking into the ground.

When the stick pin 2 is stuck into the ground, a ball-holding member 3 is placed on the top 2*a* of the stick pin 2.

To be precise, on the convex part 2*a*1 formed on the top 2*a* of the stick pin 2, the concave part 3*f* formed at the bottom 3*d* of the ball-holding member 3 described below is placed to fit.

The stick pin 2 is formed of a hard high-strength general purpose resin such as a polypropylene resin, polycarbonate resin and the like.

The ball-holding member 3 is tubular with a hollow part H inside, and has a space to contain a connecting member 4 described below.

At the bottom 3*d* of the ball-holding member 3, a small hole 3*e* is formed, and on the backside of the bottom 3*d* is formed a concave part 3*f*.

From the ball-holding member 3, a plurality of ribs 3*b* along the axial direction extend at regular intervals on the peripheral surface 3*a*.

These ribs 3*b* protrude from the upper end of the ball-holding member 3 (in other words, the round loop base 3*c*) and protrude and extend for a fixed length.

As the ball 5 is supported by the tip of these ribs 3*b*, the resistance against the ball 5 at the time of a shot decreases.

The connecting member 4 is set in the hollow part H of the ball-holding member 3 by the insertion of a small diameter portion 4*a* of the connecting member 4 described below in the small hole 3*e* of the bottom 3*d* of the ball-holding member 3.

The ball-holding member 3 is made of a cold-resistant, shock-resistant and abrasion-resistant synthetic resin such as an ionomer resin, polyethylene resin, polyamide, resin, EVA resin and the like.

On the other hand, the connecting member 4 is designed to slidably bind the ball-holding member 3 to the stick pin 2 and is made of a freely flexible material.

On the upper end of the connecting member 4, a discoidal flange 4*b* is formed and the lower end 4*c* is buried into the stick pin 2.

Grooves 4*c*1 are formed on this lower end 4*c*, and when the connecting member 4 and the stick pin 2 are joined together, the grooves fully demonstrate its effect of preventing extrication.

On the perimeter of the flange 4*b*, notches 4*b*1 are formed, the function of which will be described later.

The stick pin 2, connecting member 4 and ball-holding member 3 are mutually assembled at a stroke when the stick pin 2 and the connecting member 4 are integrated.

The connecting member 4 becomes integral with the stick pin 2 and can slide within the hollow part H of the ball-holding member 3.

Incidentally, the flange 4*b* of the connecting member 4 serves as a guide for this sliding movement guiding along the inner wall of the hollow part H.

The connecting member 4 has a function of buffering the transmission of an impact given to the ball-holding member 3 at the time of shot to the stick pin 2.

For this reason, a flexible and high tensile strength material is used. For example, it is preferable to use a synthetic resin such as a urethane elastomer resin, polyolefin elastomer resin and the like.

In the meanwhile, the protrusion length L of the ribs 3*b* protruding from the ball-holding member 3 is set at a length that does not cause any deformation beyond its plasticity.

To be more specific, the protrusion length L is set at a length that does not cause the protrusion 3*b*1 to deform beyond its plasticity and become brittle even if the ball 5 is pressed until it enters into contact with the round loop base 3*c* at the base of the protrusion 3*b*1 of the protruding ribs 3*b* and said protrusion 3*b*1 is bent radially outward.

Incidentally, when the protrusion 3*b*1 of the ribs 3*b* bent radially turn white, a permanent distortion occurs and the ribs can no longer be restored to their original position and the deformation beyond plasticity of the ribs 3*b* can be visually confirmed.

Figure 3:
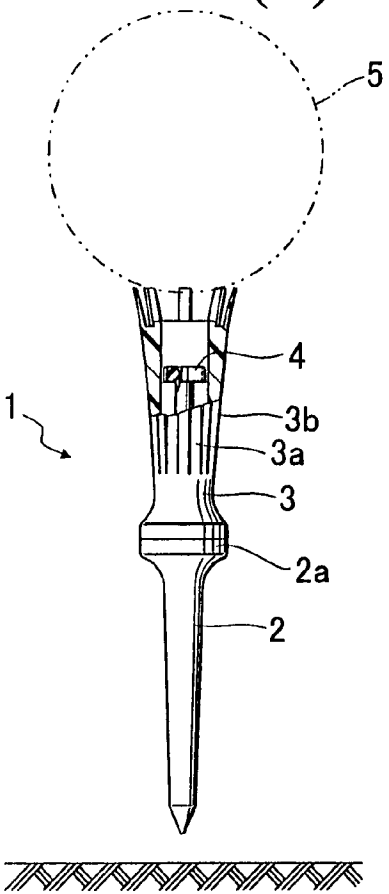
Figure 3:
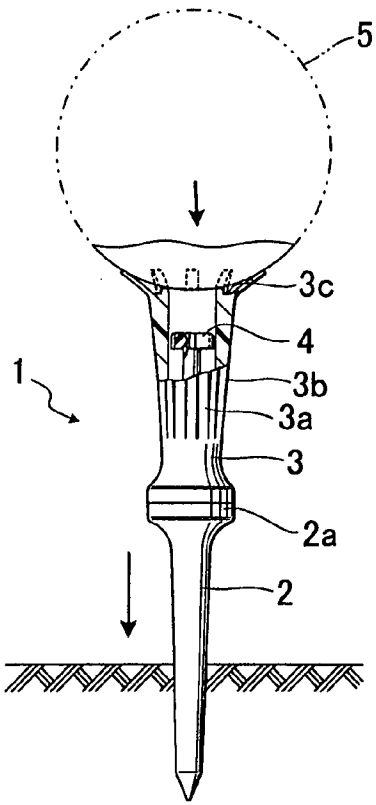
Figure 3:
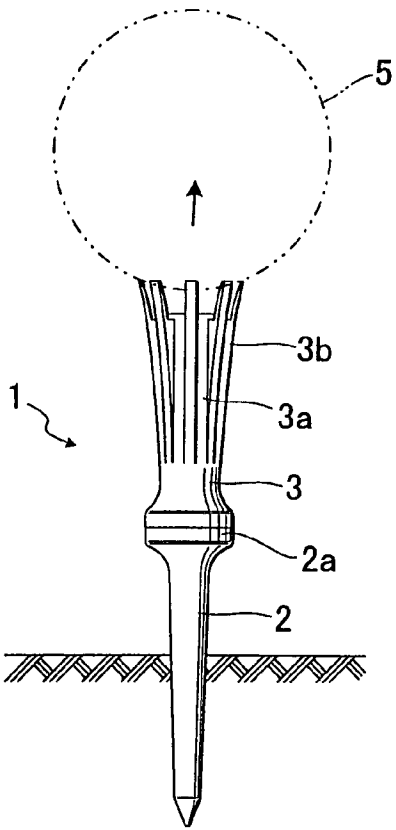

FIG. 3 is an illustration showing the process of setting the ball 5 on the ground.

FIG. 3(A) shows the state before pressing the ball 5, FIG. 3(B) shows the state where the ball 5 is pressed to be in contact with the round loop base 3*c*, and FIG. (C) shows the state where the golf tee 1 has been set into the ground.

To begin with, the ball 5 and the golf tee 1 are grasped by the hand from above (FIG. 3 (A)).

The hand is not shown in the figure, however.

The ball 5 is grasped as it is in contact with the ball-holding member 3, and the golf tee 1 together with the ball 5 are stuck into the ground.

As the ball 5 acts on the ribs 3*b* in such a way that they are pressed to expand radially, the ribs 3*b* are bent outward and their circle grows wider in diameter.

Finally, the ball 5 touches the round loop base 3*c* (FIG. 3(B)) and acts on the ball-holding member 3 in such a way as to press the same downward.

Accordingly, the stick pin 2 penetrates further deeper into the ground.

Then, when the hand is freed from the ball 5, the ball 5 returns to the state of being lifted up by the restorative force of the ribs 3*b* and supported by their top, in other words, the original state.

At this point in time, the golf tee 1 is stuck into the ground and the setting process is completed (FIG. 3(C)).

These ribs 3*b* receive a strong impact when the ball 5 is hit. However, since they are formed in a protuberant convex shape on the peripheral surface 3*a* of the ball-holding member 3, their shearing force is strong and they do not easily break.

We will now describe their action when the ball 5 placed on the golf tee 1 is hit.

Figure 4:
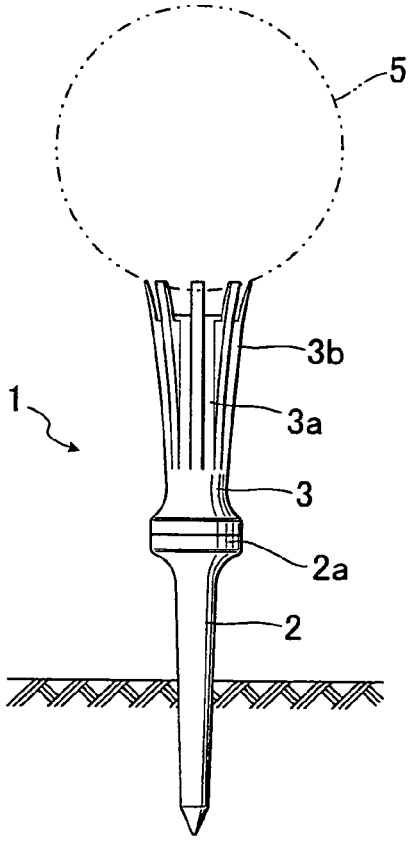
Figure 4:
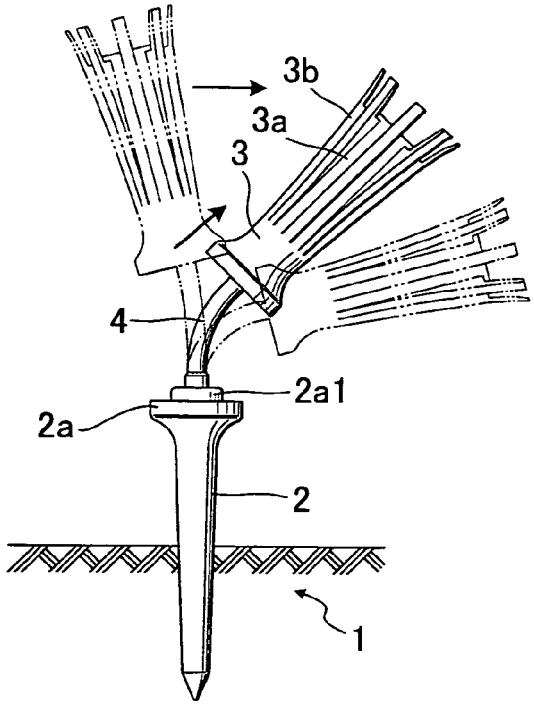
Figure 4:
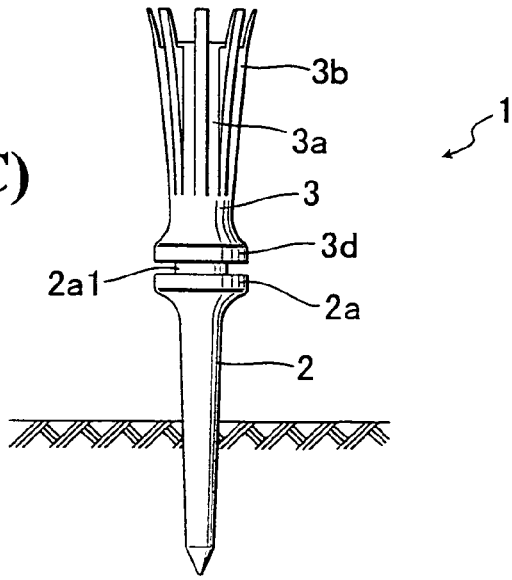

FIG. 4 is an illustration describing the action on the golf tee 1 when the ball is hit.

FIG. 4(A) shows the initial state before a shot. FIG. 4(B) shows the state of the ball-holding member 3 being inclined forward after the shot and FIG. 4(C) shows the state of the ball-holding member 3 having returned to the original position.

A ball 5 is grasped by the hand as it is in contact with the ball-holding member 3 and the golf tee 1 is stuck into the ground together with the ball 5 (FIG. 4(A)).

In this case, as described above the ball 5 and the golf tee 1 may be held in the hand to be stuck into the ground together. Or only the golf tee 1 may be stuck into the ground.

In the latter case, when the golf tee 1 is stuck into the ground and the setting process is completed, the ball 5 is placed thereon.

Incidentally, at this point in time, as shown in FIG. 2(A), the convex part 2*a*1 of the stick pin 2 is fitted into the concave part 3*f* of the ball-holding member 3 to be integrated.

Then, when the ball 5 placed on the golf tee 1 is hit (in other words 'struck'), the connecting member 4 bends following the direction of its flexion.

At that time, the ball-holding member 3 slides in the direction of separating from the stick pin 2 (see FIG. 4(B)).

To elaborate more in detail, the ball-holding member 3 is guided by the flange 4*b* of the connecting member 4 (described in FIG. 2(A)) along the inner wall forming its hollow part H, and the small hole 3*e* (described in FIG. 2(A)) at the bottom 3*d* of the ball-holding member 3 is also guided by the small diameter portion 4*a* of the connecting member 4.

This movement compresses air contained between the flange 4*b* of the connecting member 4 and the bottom 3*d* of the ball-holding member 3 (the hollow part H), while the air escapes upward through the notches 4*b*1 (see FIG. 2(B)) formed on the flange 4*b*.

Thus, this movement has a buffer effect on the golf tee 1.

Moreover, the dynamic action of the air escaping upward from the hollow part H of the ball-holding member 3 on the ball 5 results at least in a forward pushing of the same and contributes to the increase of the flight distance of the ball 5.

At the final stage, the flange 4*b* comes into contact with the bottom 3*d* of the ball-holding member 3 preventing the ball-holding member 3 from flying away.

The escape of air through the notches 4*b*1 produces a moderate absorber effect and prevents possible violent clashes of the flange 4*b* against the bottom 3*d* of the ball-holding member 3.

Thus, the golf tee 1 is prevented from flying out of the ground.

It is needless to say that in this invention the extent to which air escapes through the notches 4*b*1 is the extent to which any violent clash of the flange 4*b* with the bottom 3*d* of the ball-holding member 3 resulting in the flight of the stick pin 3 from the ground being avoided.

As a result, a moderate buffer effect of the connecting member 4 makes it difficult to transmit the impact energy to the stick pin 2 and prevents the stick pin 2 from separating and flying out of the ground.

After the shot, the head-shake action (any angle within a range of 360° is possible) of the ball-holding member 3 gradually attenuates, and finally the ball-holding member 3 descends approaching the stick pin 2 (see FIG. 4(C)), and the lower end of the ball-holding member 3 gets into contact with the convex part 2*a*1 of the stick pin 2.

In this case, as shown in FIG. 4(C), the convex part 2*a*1 of the stick pin 2 does not go as far as fitting into the concave part 3*f* on the back of the bottom of the ball-holding member 3.

As described above, the connecting member 4 and the stick pin 2 are integrated, and the insert molding method used therefor will be described here briefly.

Figure 5:
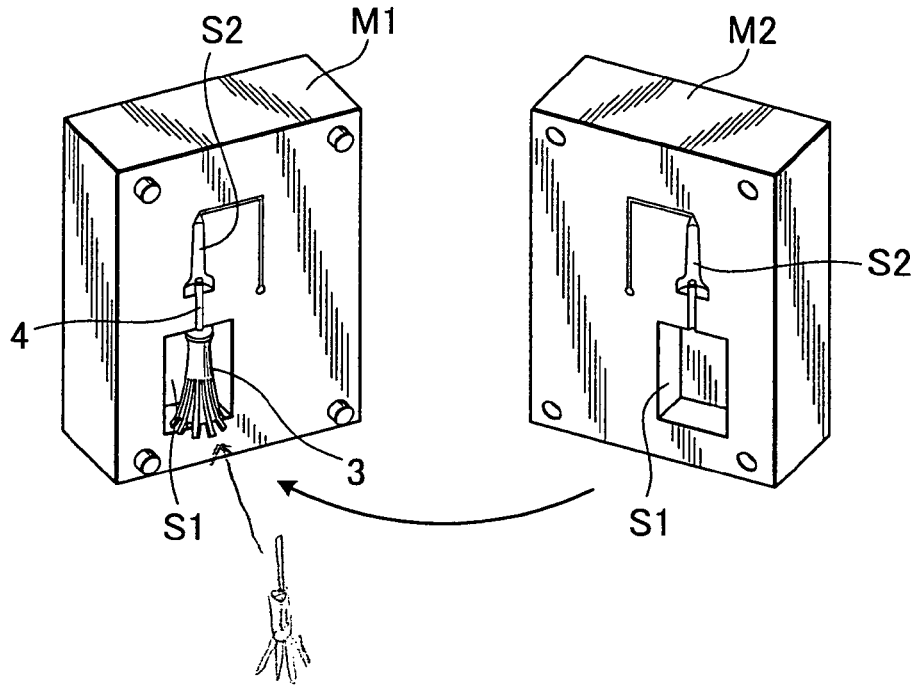
Figure 5:
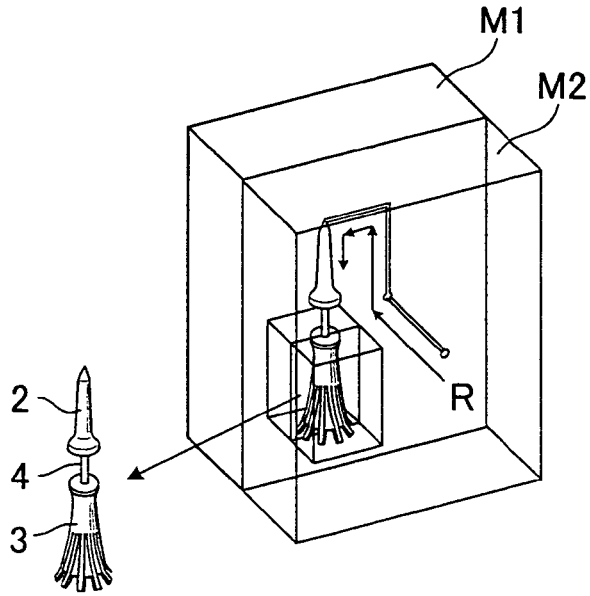

FIG. 5 is a schematic illustration showing an insert molding by using an injection molding mold.

FIG. 5(A) shows the state of an injection molding mold broken up into two parts, and FIG. 5(B) shows the state of assembly.

A split mold is used for the injection molding mold, and in the molds M1 and M2 an insert member, in other words a hollow space for installation S1 for provisionally installing the connecting member 4 and the ball-holding member 3 is formed.

Along with said hollow space for installation S1, a cavity S2 for molding the stick pin 2 is formed.

In the first place, the connecting member 4 is inserted in advance through the small hole 3*e* of the bottom 3*d* of the ball-holding member 3, and the ball-holding member 3 and the connecting member 4 are assembled.

These assembled ball-holding member 3 and connecting member 4 are fixed provisionally in the hollow space for installation S1 on one of the molds M1.

Then, the other mold M2 is joined, and a resin is injected through an inlet into the cavity S2 as shown by an arrow R.

When the molds M1 and M2 are separated, the stick pin 2, the connecting member 4 and the ball-holding member 3 are completed as they are fitted.

In this case, the lower end 4*c* of the connecting member 4 is fixed as it is buried in the stick pin 2, and the grooves 4*c*1 formed in the lower end 4*c* encroach the stick pin 2 and together they produce a strong fixative power.

Figure 6:
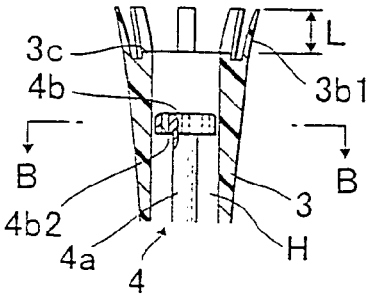
Figure 6:
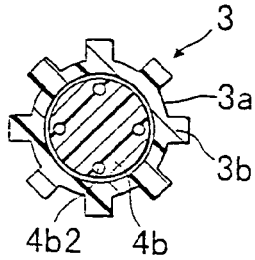

FIG. 6 is an illustration showing a variation of the connecting member 4.

FIG. 6(A) is a side view of the ball-holding member and the connecting member, and FIG. 6(B) is a sectional view along the line B—B of FIG. 6(A).

The flange 4*b* of the connecting member 4 has a number of small through holes 4*b*2, through which air escapes upward.

By changing the number and size of the small through holes 4*b*2, the extent of the buffer effect of the ball-holding member 3 can be changed.

Figure 7:
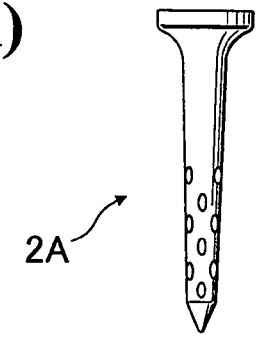
Figure 7:
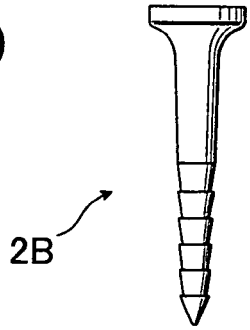
Figure 7:
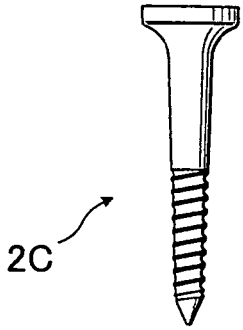
Figure 7:
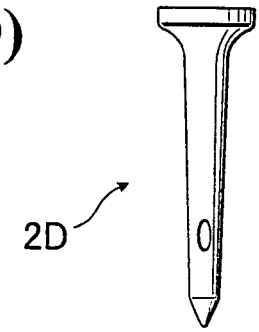

FIG. 7 is an illustration showing various means of preventing extrication provided on the stick pin 2.

FIG. 7(A) shows a stick pin 2A on which a plurality of cavities are formed, FIG. 7(B) shows a stick pin 2B provided with multi-stage arrowhead-like grooves, FIG. 7(C) shows a variation 2C on which a spiral screw is formed, and FIG. 7(D) another variation 2D on which a small through hole is formed.

In spite of the above descriptions we have made so far on this invention, this invention may not be limited to an embodiment described above and various variations are possible.

For example, the linkage between the top 2*a* of the stick pin 2 and the lower end 4*c* of the connecting member 4 may be realized by forming a rather small hole on the top 2*a* of the stick pin 2 and by inserting the lower end 4*c* of the connecting member 4 into this hole.

In this case, it is preferable to choose multi-stage arrow-head-like grooves for the grooves 4*c*1 of the lower end 4*c* of the connecting member 4.

The number of ribs 3*b* may be larger or smaller than that shown in various figures as long as they support the ball 5.

Figure 8:
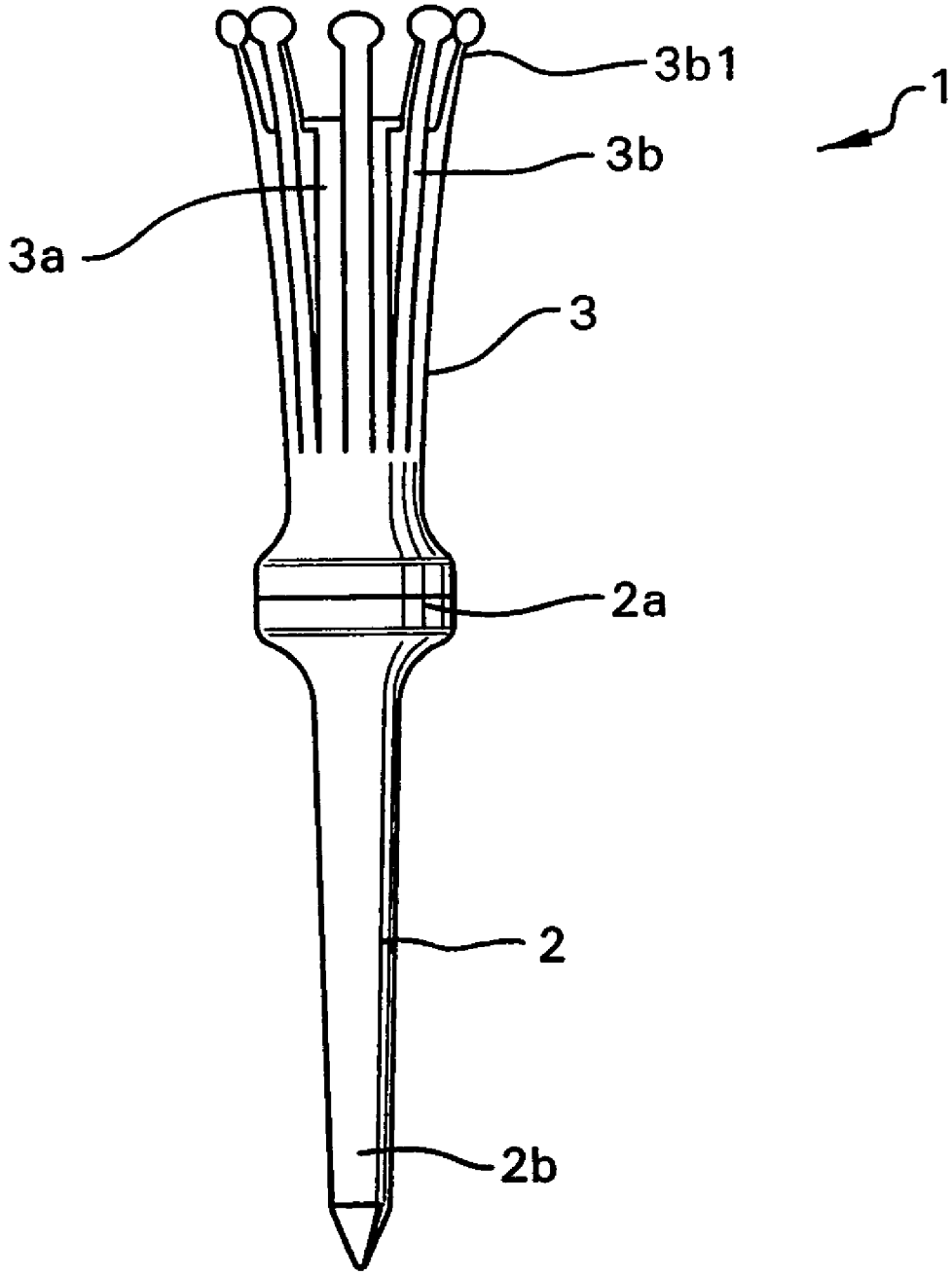
FIG. 8 is a descriptive illustration of an embodiment of the present invention having globes provided at the ends of ball-supporting ribs.

The formation of globular tops of the ribs 3*c*, as shown in FIG. 8, reduces the contact area with the ball 5, and smoothes the slide between the ribs 3*b* and the ball 5 when the golf tee 1 is stuck into the ground together with the ball 5.

As the golf tee 1 of this invention comprises three components: a stick pin 2, a ball-holding member 3 and a connecting member 4, it is possible to make the whole golf tee colorful by for example painting the ball-holding member 3 yellow, the connecting member 4 red and the stick pin 2 white.

What is claimed is:

1. A golf tee comprising:

a stick pin having a tapered lower end for insertion into the ground;

a ball-holding member for holding a ball placed on top of the stick pin and having a tubular form with a hollow part inside, a small hole provided at the bottom of the hollow part and a round loop base provided at an upper portion thereof; and a flexible connecting member having a lower end fixed with the stick pin and an upper end having a flange provided thereon, the flexible connecting member slidably binding the ball-holding member to the stick pin, wherein the connecting member is inserted into the hollow part through the small hole, the flange of the connecting member has notches for allowing air to pass upward between the flange and the ball-holding member and a plurality of ribs extend in the axial direction of the ball-holding member around the periphery thereof at a regular interval therebetween and protrude from the round loop base.

2. The golf tee according to claim 1, wherein the protrusion length L of the ribs protruding from the ball-holding member is a length that does not cause the ribs to deform beyond their plasticity and become brittle when the ribs are pressed until the ball enters into contact with the round loop base and the ribs are bent radially outward.

3. The golf tee according to claim 1, wherein the top of said stick pin is integrated by injection molding with the lower end of the connecting member.

4. The golf tee according to claim 1, wherein the top of each rib is formed in the shape of a globe.

* * * * *